US007111467B2

(12) United States Patent
Apparao et al.

(10) Patent No.: US 7,111,467 B2
(45) Date of Patent: Sep. 26, 2006

(54) ULTRA-LOW TEMPERATURE CLOSED-LOOP RECIRCULATING GAS CHILLING SYSTEM

(75) Inventors: Tamirisa V. V. R. Apparao, Fremont, CA (US); Oleg Podtcherniaev, Moscow Region (RU); Kevin P. Flynn, Novato, CA (US); Paul Hall, San Jose, CA (US); Roger Lachenbruch, Los Altos Hills, CA (US); Mikhail Boiarski, Macungie, PA (US)

(73) Assignee: Brooks Automation, Inc., Chelmsford, MA (US)

( * ) Notice: Subject to any disclaimer, the term of this patent is extended or adjusted under 35 U.S.C. 154(b) by 151 days.

(21) Appl. No.: 10/470,123

(22) PCT Filed: Feb. 25, 2002

(86) PCT No.: PCT/US02/05801

§ 371 (c)(1),
(2), (4) Date: Feb. 9, 2004

(87) PCT Pub. No.: WO02/095308

PCT Pub. Date: Nov. 28, 2002

(65) Prior Publication Data

US 2004/0129015 A1 Jul. 8, 2004

Related U.S. Application Data

(60) Provisional application No. 60/214,562, filed on Jul. 1, 2001, provisional application No. 60/271,140, filed on Feb. 23, 2001.

(51) Int. Cl.
*F25B 7/00* (2006.01)
*F25B 41/00* (2006.01)

(52) U.S. Cl. ..... 62/79; 62/175; 62/335

(58) Field of Classification Search ..... 62/79, 62/113, 114, 175, 335, 513
See application file for complete search history.

(56) References Cited

U.S. PATENT DOCUMENTS

| | | | |
|---|---|---|---|
| 3,590,595 | A | 7/1971 | Briggs |
| 4,122,688 | A | 10/1978 | Mochizuki et al. |
| 4,506,521 | A | 3/1985 | Asano et al. |
| 4,535,597 | A | 8/1985 | Missimer et al. |
| 4,535,598 | A | 8/1985 | Mount |
| 4,597,267 | A | 7/1986 | Forrest |
| 4,597,268 | A | 7/1986 | Andersson |
| 4,763,486 | A | 8/1988 | Forrest et al. |
| 4,788,829 | A | 12/1988 | Takemasa et al. |
| 4,831,835 | A | 5/1989 | Beehler et al. |

(Continued)

FOREIGN PATENT DOCUMENTS

| | | |
|---|---|---|
| DE | 198 21 308 A1 | 11/1999 |

(Continued)

*Primary Examiner*—Harry B. Tanner
(74) *Attorney, Agent, or Firm*—Hamilton, Brook, Smith & Reynolds, P.C.

(57) ABSTRACT

Disclosed is an ultra-low temperature, dual-compressor (114,144), recirculating gas chilling system that includes a closed-loop mixed-refrigerant primary refrigeration system (110) in combination with a closed-loop gas secondary refrigeration loop (112). The ultra-low temperature, dual-compressor (114,144), recirculating gas chilling system disclosed is capable of providing continuous long term chilled gas and fast cooling of a high or ambient temperature object (158), such as a chuck used in processing semiconductor wafers or any such device. The gas chilling system is characterized by three modes of operation: a normal cooling mode, a bakeout mode, and a post-bake cooling mode.

27 Claims, 1 Drawing Sheet

U.S. PATENT DOCUMENTS 4,850,199 A 7/1989 DiNovo et al.
4,926,658 A 5/1990 Olsen et al.
5,076,067 A 12/1991 Prenger et al.
5,087,381 A 2/1992 Tamura et al.
5,170,639 A 12/1992 Datta
5,182,920 A 2/1993 Matsuoka et al.
5,337,572 A 8/1994 Longsworth
5,339,654 A 8/1994 Cook et al.
5,396,777 A 3/1995 Martin
5,425,890 A 6/1995 Yudin et al.
5,441,658 A 8/1995 Boyarsky et al.
5,524,442 A 6/1996 Bergman, Jr. et al.
5,579,654 A 12/1996 Longsworth et al.
5,640,854 A 6/1997 Fogt et al.
5,644,502 A 7/1997 Little
5,685,163 A 11/1997 Fujita et al.
5,702,632 A 12/1997 Weng
5,715,694 A 2/1998 Yakumaru et al.
5,724,832 A 3/1998 Little et al.
5,730,216 A 3/1998 Viegas et al.
5,749,243 A 5/1998 Lester
5,910,161 A 6/1999 Fujita et al.
6,006,542 A 12/1999 Tojo et al.
6,017,205 A 1/2000 Weatherston et al.
6,041,621 A 3/2000 Olszewski et al.
6,055,827 A 5/2000 Tojo et al.
6,073,454 A 6/2000 Spauschus et al.
6,076,366 A 6/2000 Takano et al.
6,076,368 A 6/2000 Noble
6,076,372 A 6/2000 Acharya et al.
6,089,033 A 7/2000 Dubé
6,098,421 A 8/2000 Fujita et al.
6,105,388 A 8/2000 Acharya et al.
6,112,534 A 9/2000 Taras et al.
6,112,547 A 9/2000 Spauschus et al.
6,148,634 A 11/2000 Sherwood
6,167,722 B1 1/2001 Kasezawa et al.
6,176,102 B1 1/2001 Novak et al.
6,189,329 B1 2/2001 Peterson
6,206,652 B1 3/2001 Caillat
RE37,119 E 4/2001 Sherwood
6,233,955 B1 5/2001 Egara
6,258,292 B1 7/2001 Turner
6,293,335 B1 9/2001 Tawney et al.
6,301,923 B1 10/2001 Bonaquist et al.
6,306,803 B1 10/2001 Tazaki
6,330,811 B1 12/2001 Arman
6,474,082 B1 11/2002 Flynn
6,481,223 B1 11/2002 Flynn et al.
6,502,410 B1 1/2003 Podtchereniaev et al.
6,560,981 B1 5/2003 Flynn
6,574,978 B1 6/2003 Flynn et al.
6,644,067 B1 11/2003 Stenhouse
6,722,145 B1 4/2004 Podtchereniaev et al.
6,843,065 B1 1/2005 Flynn
2001/0042379 A1 11/2001 Flynn et al.
2002/0017106 A1 2/2002 Flynn et al.
2002/0023447 A1 2/2002 Podtchereniaev et al.

FOREIGN PATENT DOCUMENTS

JP 05118677 A 5/1993

ULTRA-LOW TEMPERATURE CLOSED-LOOP RECIRCULATING GAS CHILLING SYSTEM

CROSS-REFERENCES TO RELATED APPLICATIONS

The application claims the benefit of the filing date of U.S. Provisional Application No. 60/271,140 filed Feb. 23, 2001 and U.S. Provisional Application No. 60/214,562 filed on Jul. 1, 2001.

FIELD OF THE INVENTION

The present invention relates to apparatus and processes for the modification of the heat intensity of elements at temperatures ranging from ultra-low to high, contained in a closed loop heat exchanger, more particularly to such apparatus and processes utilized in the manufacture of semiconductor wafers.

BACKGROUND OF THE INVENTION

Refrigeration systems have been in existence since the early 1900s, when reliable sealed refrigeration systems were developed. Since that time, improvements in refrigeration technology have proven their utility in both residential and industrial settings. In particular, "ultra-low" temperature refrigeration systems currently provide essential industrial functions in biomedical applications, cryoelectronics, coating operations, and semiconductor manufacturing and test applications.

In many of these applications, it is necessary that a system element, such as a semiconductor wafer holder or other device [hereafter sometimes referred to as an external heat load heat exchanger] be cycled through both heating and cooling regimes, depending on the specific processing step. During normal operations, it is necessary to cool and maintain the device at ultra-low temperatures.

During start up, or when vacuum has been lost or the process interrupted for some reason, it is necessary to supply high heat. In the case of an external heat load heat exchanger, such as a semiconductor wafer chuck in a clean room environment, a bakeout process is needed to clean the external heat load heat exchanger by burning off any accumulated impurities. A bakeout process is the heating of all surfaces in a vacuum chamber to remove water vapor and other contaminants after the chamber has been exposed to the atmosphere, such as occurs when the chamber is opened for maintenance. Conventional techniques of performing a bakeout process involve heating the surfaces of the system element with a heater to above +200° C. for a prolonged period of time.

In these applications, a temperature modification system must also be capable of accommodating the bakeout process and the post bakeout cooling requirements of the system where the element must be brought down to or near ambient temperature prior to the commencement or resumption of normal operations. Consequently, it is necessary that the system provides a bakeout cucle, as well as a post-bake cooling cycle, different from the normal cooling cycle, in which the external heat load heat exchanger is cooled from the bakeout temperature down to near ambient temperature. Thereafter, the normal cooling cycle brings the element down to the normal cold operating temperature range between −50 and −150° C.

For the purposes of this application, "heating" refers to the addition of heat from an object or fluid, "refrigeration" refers to the removal of heat from an object or fluid (gas or liquid) at temperatures below room temperature, and "ultra-low" temperature refers to the temperature range between −50 and −150° C.

For the purposes of this application, a heat exchanger means a device that causes heat to be transferred from one media to another.

All heat exchangers described in this application are indirect heat exchangers, that is, the media do not come into physical contact.

An external heat load heat exchanger refers to the thermal interface at which heat is removed from an object or fluid and transferred to a cooling medium.

Prior art gas systems have not been integrated systems and have not contemplated providing both heating and refrigeration within the same system. Furthermore, prior art chilling systems used to provide ultra-low temperature chilled gas to such applications are of open loop design.

Various refrigeration cycles may be utilized to provide the ultra-low temperatures for the chilled gas such as a Missimer type auto-refrigerating cascade, U.S. Pat. No. 3,768,273; a Klimenko type single-phase separator system, or a single expansion device type such as disclosed in U.S. Pat. No. 5,441,658. Further examples of open loop gas chillers are products made by IGC Polycold Systems (formerly of San Rafael, Calif., now located in Petaluma, Calif.), such as the PGC-150 and the PGC-100. Such systems typically are used to chill a stream of pressurized nitrogen gas from room temperature to between −90 C and −130° C., depending on the specific model and flow rate, with the flow rates of the cooled gas ranging between 0 and 15 scfm.

In current open loop systems, ambient temperature gas at low to medium pressure is chilled to ultra-low temperatures in an open loop where the chilled gas provides the necessary cooling to the external heat load heat exchanger or other surface to be cooled. After providing cooling to the external heat load heat exchanger the gas is vented. The refrigeration process has the benefit of being able to operate in steady-state conditions for extended time periods of days to months provided there is continuous supply of fresh, clean, and dry gas.

However, there are numerous negative aspects to such systems.

In open loop gas chilling systems the refrigerant gas is simply exhausted into the surrounding environment after the external heat load heat exchanger has been cooled. Consequently, a gas source must be provided that is capable of continuously replenishing the refrigerant gas within the refrigeration system in order to maintain proper gas pressure and flow rate. The need to provide a continuous gas supply is very costly to the user, is not cost-effective due to the open loop design and is a serious drawback of the prior art gas chilling systems.

Since in open-loop gas refrigeration systems the ultra-low temperature gas is simply exhausted into the surrounding environment after the external heat load heat exchanger has been cooled, there is a tendency for condensation and frost buildup to occur on the exhaust vent that is typically located within a semiconductor manufacturing clean room.

Consequently, another drawback of the prior art open-loop gas chilling systems is the detrimental presence of condensation and frost within a clean room environment of a semiconductor manufacturing process. Similarly, in the bakeout process, simply exhausting high temperature gas into the surrounding environment may be detrimental to the semiconductor manufacturing process and to the environment.

Lastly, in the case of a large-scale manufacturing process having multiple external heat load heat exchangers to be cooled, a very large gas flow rate is required to achieve the cooling of multiple external heat load heat exchangers. Since open-loop gas chilling systems require a gas source to continuously replenish the spent gas, a gas source capable of supplying this large volume of gas is needed in order to maintain the proper gas pressure and flow rate to all external heat load heat exchangers to be cooled.

Thus, another drawback of the prior art open loop gas chilling systems is the requirement of having a gas source capable of supplying the large volume of gas needed for the cooling of multiple external heat load heat exchangers.

Recently, refrigeration systems have appeared which are based on closed loop principles. For examples, U.S. Pat. No. 6,105,388, entitled "Multiple Circuit Cryogenic Liquefaction Of Industrial Gas"; U.S. Pat. No. 6,041,621, entitled "Single Circuit Cryogenic Liquefaction Of Industrial Gas"; and U.S. Pat. No. 6,301,923, entitled "Method For Generating A Cold Gas," describe various methods of generating a closed loop gas stream cooled by a refrigeration system.

In semiconductor manufacturing processes refrigeration is required to reduce the temperature of the object being cooled from an initial temperature in the range of 250 to 300° C. such as a chuck used in processing semiconductor wafers, or any other such device. When closed loop refrigeration systems are utilized to cool the hot semiconductor objects, the extra heat load imposes a serious constraint on the process as it is necessary in such processes to deal with the hot gas that returns to the closed loop system as the initially very hot object cools Since the systems described in U.S. Pat. Nos. 6,105,388, 6,041,621 and 6,301,923 are concerned with the production of industrial gases from an ambient temperature gas source, these systems are directed to and only address the basic refrigeration function. Such systems do not provide multi-cycle integrated temperature modification and are unable to handle heat exchange media returning from a hot external heat load heat exchanger.

Prior closed loop refrigeration processes do not recognize or resolve the problem of managing returning gas at high temperatures. Therefore, the arrangement of components described in the prior art would fail to function as needed for the processes just described.

Industrial processes intended for continuous running must address the potential for leaks to assure that the system may continually operate over long periods of time even during the occurrence of minor leaks that cause a loss of gas.

Thus, there is a need in the industry for a chilling process that is capable of cooling an initially hot object, that does not require the provision of large amounts of cooling fluid, that does not exhaust spent coolant fluid to the atmosphere and that provides for the replenishment of small quantities of make-up heat exchange medium as required.

It is therefore an object of the invention to provide a closed-loop gas chiller system, thereby providing a means to recirculate chilled gas and eliminate the costly need to constantly replenish the total flow of chilled gas supplied to the customer-installed external heat load heat exchanger, such as a chuck used in processing semiconductor wafers, or any such device It is another object of the invention to use a gas rather than a liquid as a cooling medium in a closed-loop system.

It is yet another object of the invention to eliminate the exhaust vent that over time may accumulate a frost buildup.

It is yet another object of the invention to eliminate hot gas being exhausted into the manufacturing environment, such as a clean room, during the bakeout process.

It is yet another object of the invention to manage the post bakeout high temperature gas returning from the hot external heat load heat exchanger without adversely affecting the primary loop refrigeration system.

It is yet another object of the invention to eliminate the need for a large-capacity supply line for maintaining sufficient gas pressure and flow rate within a large-scale open-loop process, utilizing multiple customer-installed external heat load heat exchangers.

It is yet another object of the invention to have an automatic make up of circulating gas to replenish the gas lost in the system due to leaks, to maintain the desired operating pressures on the suction and discharge side of a secondary loop gas, to allow for contraction and expansion of gas due to variation in the gas temperature, and to provide a continuous operation.

SUMMARY OF THE INVENTION

Figure 1:
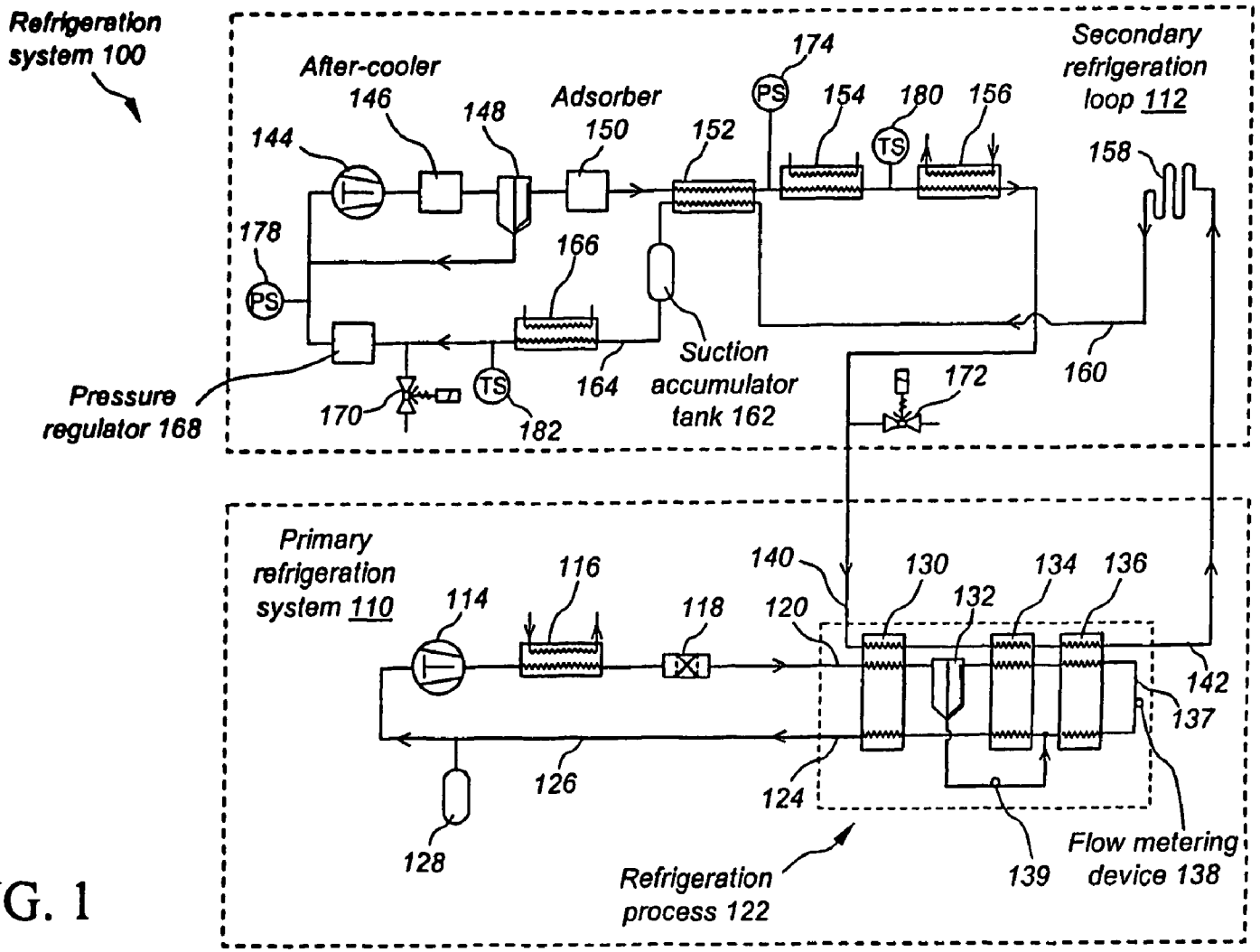
FIG. 1 is a schematic diagram of an ultra-low temperature, dual compressor, recirculating, gas chilling system that uses a mixed-refrigerant refrigeration system in combination with a closed-loop gas secondary refrigeration loop in accordance with the invention.

This application describes cooling by means of an integrated system utilizing a closed loop gas stream, in which heat is added to or removed from the gas stream as the temperature of an object or fluid of interest is modified.

The present invention comprises an integrated process for management of the heat requirements of a semiconductor manufacturing or like process and apparatus for the practice of such integrated process.

The integrated process comprises a three cycle temperature modification regime in which 1] an external heat load heat exchanger present in a vacuum environment is heated to high temperatures to remove impurities in the heat exchanger, 2] the heat exchanger is cooled to or near ambient after removal of such impurities; and 3] the temperature of the heat exchanger is reduced to a temperature in the range of −50 to −150° C.

The apparatus for accomplishing the integrated process comprises an ultra-low temperature, dual-compressor, recirculating, refrigeration system which includes a closed-loop mixed-refrigerant primary refrigeration system in combination with a closed-loop gas secondary refrigeration loop. The gas used in the secondary refrigeration loop is any dry gas with a dew point below −100° C., such as helium or nitrogen.

FIG. 1 is a schematic diagram of an ultra-low temperature, dual-compressor, recirculating, refrigeration system in accordance with the invention.

The refrigeration process of the primary refrigeration system includes a series of heat exchangers with a phase separator interposed between them. FIG. 1 shows one phase separator; preferentially there is more than one.

In a supply flow path, refrigerant flowing into the supply inlet of the refrigeration process feeds the first heat exchanger, whose outlet subsequently feeds a supply inlet of the phase separator. The flow continues through the additional heat exchangers whose outlet subsequently feeds a refrigerant supply line.

The refrigerant exiting the supply flow path of the refrigeration process via the refrigerant supply line is high-pressure refrigerant and expands through a flow-metering device (FMD). The refrigerant exiting the outlet of the FMD is low pressure, low temperature refrigerant, typically between −50 and −150° C. The FMD closes the loop back to a return flow path of the refrigeration process by connecting directly to a return inlet of the first of a series of heat exchanges. The liquid fraction removed by the phase separator is expanded to low pressure by another FMD and is then blended with the low-pressure refrigerant flowing from the return side of one the heat exchangers. A return outlet of the last heat exchanger subsequently feeds the compressor suction line via the return outlet of the refrigeration process.

In more elaborate auto-refrigerating cascade systems additional stages of separation may be employed in the refrigeration process, as described by Missimer and Forrest.

The refrigeration process also includes an inlet feeding a secondary flow path through the refrigeration process. The inlet feeds a secondary flow inlet of the first of a series of heat exchangers. A secondary flow outlet of the last of the series of heat exchangers feeds a gas feed line.

The inlet and the evaporator feed line provide functional coupling between the primary refrigeration system and the secondary refrigeration loop.

All elements of the primary refrigeration system are mechanically and/or hydraulically connected.

The primary refrigeration system is an ultra-low temperature refrigeration system; its basic operation, which is the removal and relocation of heat, is well known in the art. It comprises a compressor, a condenser, a filter drier and the refrigeration process, which has an internal refrigerant flow path from high to low pressure.

The refrigerant flowing in the supply side is progressively cooled as it passes through a series of heat exchangers. This progression produces very cold refrigerant, typically between −50 and −150° C., at high pressure that is fed directly back into the return side of the refrigeration process via the FMD. Due to the heat transfer from the supply side to the return side of the heat exchangers, and within the refrigeration process, the refrigerant flowing in the return side is progressively warmed via the action of the series of heat exchangers, finally producing low-pressure refrigerant gas feeding the compressor via the suction line.

In a preferred embodiment, the primary refrigeration system uses a nonflammable, chlorine-free, nontoxic, mixed-refrigerant blend.

The secondary refrigeration loop includes a gas compressor, preferably one suitable for use with any dry gas with a dew point below −100° C., such as helium or nitrogen The compressor may conveniently be a commercially available reciprocating compressor, rotary compressor, screw compressor, or scroll compressor.

The discharge gas stream from the compressor is connected to an after-cooler. The outlet of the after-cooler feeds a conventional oil separator that separates the oil from the discharge gas stream and returns the oil to the suction side of the compressor. The mass flow from the oil separator, minus the oil removed, feeds an adsorber.

The adsorber may conveniently be a charcoal adsorber or a molecular sieve. The adsorber removes any remaining traces of oil in the discharge gas stream. The adsorber is connected to a supply inlet of a recuperative heat exchanger. A supply outlet of the recuperative heat exchanger is connected to an inlet of a conventional water-cooled heat exchanger.

A heater for controlling the temperature of the gas stream leaving the recuperative heat exchanger is optionally interposed in the line between the supply outlet of the recuperative heat exchanger to the inlet of the heat exchanger.

The outlet of the heat exchanger is connected to the secondary flow path within the refrigeration process of the primary refrigeration system via the inlet.

In systems without the optional heat exchanger and optional in-line electric heater the recuperative heat exchanger is connected to the secondary flow path within the refrigeration process of the primary refrigeration system via the inlet. The evaporator feed line from the primary refrigeration system connects to an inlet of a customer-installed external heat load heat exchanger.

An outlet of the customer-installed external heat load heat exchanger feeds a return inlet of the recuperative heat exchanger via a return line. A return outlet of the recuperative heat exchanger subsequently feeds the suction side of the compressor via a suction line. As the gas stream flows from the return outlet of the recuperative heat exchanger to the pressure regulator it is exposed to an optional in-line electric heater that is used for controlling the temperature of the gas stream entering the compressor.

DETAILED DESCRIPTION OF THIS INVENTION

FIG. 1 is a schematic diagram of an ultra-low temperature, dual-compressor, recirculating, refrigeration system 100 in accordance with the invention. The refrigeration system 100 includes a closed-loop mixed-refrigerant primary refrigeration system 110 in combination with a closed-loop gas secondary refrigeration loop 112, where the gas used in the secondary refrigeration loop 112 is, for example, any dry gas with a dew point below −100° C., such as helium or nitrogen. The gas does not condense at the operating temperatures and pressures.

The primary refrigeration system 110 includes a conventional refrigeration compressor 114 that takes low-pressure refrigerant gas and compresses it to high-pressure, high-temperature gas that is fed to a conventional condenser 116, which is the part of the primary refrigeration system 110 where the heat is rejected by condensation. As the hot gas travels through condenser 116, it is cooled by air or water passing through or over it. As the hot gas refrigerant cools, drops of liquid refrigerant form within its coil. Eventually, when the gas reaches the outlet of condenser 116, it has condensed partially; that is, liquid and vapor refrigerant are present. In order for condenser 116 to function correctly, the air or water passing through or over the condenser 116 must be cooler than the working fluid of the primary refrigeration system 110. The condenser 116 subsequently feeds a filter drier 118 that adsorbs system contaminants, such as water, which can create acids, and provides physical filtration. The refrigerant from filter drier 118 then feeds a supply inlet 120 of a refrigeration process 122.

A return outlet 124 of the refrigeration process 122 closes the loop by connecting back to the suction side of the compressor 114 via a suction line 126. Furthermore, connected to the suction line 126 may be a conventional expansion tank 128, which serves as a reservoir that accommodates increased refrigerant volume caused by evaporation and expansion of refrigerant gas due to heating. For example, when the primary refrigeration system 110 is off, refrigerant vapor enters the expansion tank 128.

FIG. 1 illustrates an exemplary refrigeration process 122. The refrigeration process 122 is any refrigeration system or process, such as a single-refrigerant system, a mixed-refrigerant system, normal refrigeration processes, an individual stage of a cascade refrigeration processes, an auto-refrigerating cascade cycle, or a Klimenko cycle. For the purposes of illustration in this disclosure, the refrigeration process 122 is a simplified version of an auto-refrigerating cascade cycle that is also described by Klimenko. Alternatively, however, the refrigeration process 122 may be the Polycold system (i.e., auto-refrigerating cascade process), APD Cryogenics system with single expansion device (i.e., a single stage cryocooler having no phase separation, U.S. Pat. No. 5,441,658), Missimer type cycle (i.e., an auto-refrigerating cascade, Missimer U.S. Pat. No. 3,768,273), or Klimenko type (i.e., a single-phase separator system). Additionally, the refrigeration process 122 may be variations on these processes, such as described in Forrest patent 4,597,267 and Missimer U.S. Pat. No. 4,535,597, or any very low-temperature refrigeration process with zero, one, or more than one stages of phase separation. A further reference for low-temperature and very low-temperature refrigeration can be found in Chapter 39 of the 1998 ASHRAE Refrigeration Handbook produced by the American Society of Heating, Refrigeration, and Air Conditioning Engineering. In addition to the number of phase separators used, the number of heat exchangers and the number of internal throttle devices used can be increased or decreased in various arrangements as appropriate for the specific application.

The refrigeration process 122 of the primary refrigeration system 110 includes a heat exchanger 130, a phase separator 132, a heat exchanger 134, and a heat exchanger 136. The heat exchanger 130, the heat exchanger 134, and the heat exchanger 136 are devices that are well known in the industry for transferring the heat of one substance to another. The phase separator 132 is a device that is well known in the industry for separating the refrigerant liquid and vapor phases. FIG. 1 shows one phase separator, however, typically there may be more than one.

In a supply flow path, refrigerant flowing into the supply inlet 120 of the refrigeration process 122 feeds a supply inlet of the heat exchanger 130. A supply outlet of the heat exchanger 130 subsequently feeds a supply inlet of the phase separator 132. A supply outlet of the phase separator 132 subsequently feeds a supply inlet of the heat exchanger 134. A supply outlet of the heat exchanger 134 subsequently feeds a supply inlet of the heat exchanger 136. A supply outlet of the heat exchanger 136 subsequently feeds a refrigerant supply line 137. The refrigerant exiting the supply flow path of the refrigeration process 122 via the refrigerant supply line 137 is high-pressure refrigerant and expands through a flow-metering device (FMD) 138. The refrigerant exiting the outlet of the FMD 138 is low pressure, low temperature refrigerant, typically between −50 and 150° C. The FMD 138 closes the loop back to a return flow path of the refrigeration process 122 by connecting directly to a return inlet of the heat exchanger 136. A return outlet of the heat exchanger 136 subsequently feeds a return inlet of the heat exchanger 134. The liquid fraction removed by the phase separator 132 is expanded to low pressure by another (FMD) 139. The FMDs 138 and 139 are flow metering devices, such as a capillary tubes, orifices, proportional valves with feedback, or any restrictive elements that control flow. Refrigerant flows from the FMD 139 and is then blended with the low-pressure refrigerant flowing from the return side of the heat exchanger 136 to a return inlet of the heat exchanger 134. This mixed flow feeds a return inlet of the heat exchanger 134. A return outlet of the heat exchanger 134 subsequently feeds a return inlet of the heat exchanger 130. A return outlet of the heat exchanger 130 subsequently feeds the compressor suction line 126 via the return outlet 124 of the refrigeration process 122. In more elaborate auto-refrigerating cascade systems additional stages of separation may be employed in the refrigeration process 122, as described by Missimer and Forrest.

Finally, the refrigeration process 122 includes an inlet 140 feeding a secondary flow path through the refrigeration process 122. The inlet 140 feeds a secondary flow inlet of the heat exchanger 130. A secondary flow outlet of the heat exchanger 130 subsequently feeds a secondary flow inlet of the heat exchanger 134. A secondary flow outlet of the heat exchanger 134 subsequently feeds a secondary flow inlet of the heat exchanger 136. A secondary flow outlet of the heat exchanger 136 subsequently feeds an evaporator feed line 142. The inlet 140 and the evaporator feed line 142 provide functional coupling between the primary refrigeration system 110 and the secondary refrigeration loop 112 that is described in detail below.

All elements of the primary refrigeration system 110 are mechanically and/or hydraulically connected.

The primary refrigeration system 110 is an ultra-low temperature refrigeration system and its basic operation, which is the removal and relocation of heat, is well known in the art. Referring to FIG. 1, the operation of the primary refrigeration system 110 is summarized as follows. Hot, high-pressure gas exits the compressor 114 and travels through the condenser 116, where it is cooled by air or water passing through or over it. When the gas reaches the outlet of the condenser 116, it has condensed partially and is a mixture of liquid and vapor refrigerant. The liquid and vapor refrigerant exiting the condenser 116 flows through the filter drier 118 and then feeds the supply side of the refrigeration process 122, which has an internal refrigerant flow path from high to low pressure. The refrigerant flowing in the supply side is progressively cooled as it passes through first the heat exchanger 130, then the heat exchanger 134, and finally through the heat exchanger 136. This progression produces ultra-low temperature refrigerant, typically between −50 and −150° C., at low pressure that is fed directly back into the return side of the refrigeration process 122 via the FMD 138. Due to the heat transfer from the supply side to the return side of the heat exchangers 130, 134, and 136 within the refrigeration process 122, the refrigerant flowing in the return side is progressively warmed via the action of first the heat exchanger 136, then the heat exchanger 134, and finally the heat exchanger 130. Finally, the low-pressure refrigerant gas feeds the compressor 114 via the suction line 126.

In a preferred embodiment, the primary refrigeration system 110 uses a nonflammable, chlorine-free, nontoxic, mixed-refrigerant blend that is suitable for use with an ultra-low temperature throttle-cycle refrigeration system or process of various configurations, such as a mixed-refrigerant system, an auto-refrigerating cascade cycle, a Klemenko cycle, or a single expansion device system. The nonflammable, chlorine-free, nontoxic, mixed-refrigerant blends are described in U.S. Provisional Application No. 60/214,562 filed Jul. 1, 2001.

With continuing reference to FIG. 1, the secondary refrigeration loop 112 includes a gas compressor 144 that takes low-pressure gas and compresses it to high-pressure, high-temperature gas. The compressor 144 is preferably one suitable for use with any dry gas with a dew point below −100° C., such as helium or nitrogen. Compressor 144 may conveniently be a commercially available reciprocating compressor, rotary compressor, screw compressor, or scroll compressor, one example being a scroll compressor manufactured by Copeland Corporation as described in Wetherstone, et al., U.S. Pat. No. 6,017,205. These compressors are oil lubricated and removal of oil from the gas stream is a critical aspect of the design.

The discharge gas stream from the compressor 144 feeds an after-cooler 146 that is a conventional air-cooled or water-cooled heat exchanger for removing the heat of compression from the compressed gas that is exiting the compressor 144. The outlet of the after-cooler 146 feeds a conventional oil separator 148 that separates the oil from the discharge gas stream and returns the oil to the suction side of the compressor 144. The mass flow from the oil separator 148, minus the oil removed, feeds an adsorber 150.

The adsorber 150 may conveniently be a charcoal adsorber or a molecular sieve originally designed for helium but which was found to work well for nitrogen in this application. The adsorber 150 removes any remaining traces of oil in the discharge gas stream, such that the gas stream exiting the adsorber 150 is very clean. More specifically, the oil concentration level in the discharge gas stream is brought to the minimum tolerable value, which could be as low as 1.0–10.0 parts per billion (ppm) or lower.

The clean gas stream exits the adsorber 150 and subsequently feeds a supply inlet of a recuperative heat exchanger 152, which is a heat exchanger device that is well known in the industry for transferring the heat of one substance to another. A supply outlet of the recuperative heat exchanger 152 then optionally feeds an inlet of a conventional water-cooled heat exchanger 156.

As the gas stream flows from the supply outlet of the recuperative heat exchanger 152 to the inlet of the heat exchanger 156 it is optionally exposed to heater 154 for controlling the temperature of the gas stream leaving the recuperative heat exchanger 152. Optional heater 154 is a conventional in-line electric heater, such as one manufactured by the Omega Company. The outlet of the heat exchanger 156 then feeds the secondary flow path within the refrigeration process 122 of the primary refrigeration system 110 via the inlet 140.

In systems without the optional heat exchanger 156 and optional in-line electric heater 154 the gas leaves the recuperative heat exchanger 152 and then feeds the secondary flow path within the refrigeration process 122 of the primary refrigeration system 110 via the inlet 140. The evaporator feed line 142 from the primary refrigeration system 110 connects to an inlet of a customer-installed external heat load heat exchanger 158.

The customer-installed external heat load heat exchanger 158 is a external heat load heat exchanger or any surface to be cooled, such as a wafer chuck. An external heat load heat exchanger refers to a thermal interface from which heat is removed from an object or fluid and transferred to a cooling media. In some cases the object cooled is a metallic element. The source of heat for this metallic element could be a plasma deposition process or other physical vapor deposition processes, a fluid flowing over the metallic element, or electric heat, or the initial temperature of the metallic element. In practice, these various heat sources may be present in any combination. Further, the object cooled need not be made of metal. The only requirements are that the element provide safe containment of the closed loop gas, which is typically under pressure, provide an adequate flow path, and sufficient thermal interface with the object being cooled to support heat transfer at the required rate.

An outlet of the customer-installed external heat load heat exchanger 158 feeds a return inlet of the recuperative heat exchanger 152 via a return line 160. The refrigerant supply and return lines connecting to the customer-installed external heat load heat exchanger 158 are insulated lines, such as vacuum jacketed lines. A return outlet of the recuperative heat exchanger 152 subsequently feeds the suction side of the compressor 144 via a suction line 164. Disposed in series in the suction line 164 between the recuperative heat exchanger 152 and the compressor 144 is a suction accumulator tank 162 that subsequently feeds an optional conventional pressure regulator 168. As the gas stream flows from the return outlet of the recuperative heat exchanger 152 to the pressure regulator 168 it is exposed to an optional in-line electric heater 166 that is used for controlling the temperature of the gas stream entering the compressor 144.

The suction accumulator tank 162 is a conventional suction accumulator that dampens any pressure fluctuations due to gas density variation, thereby minimizing the pressure variation on the suction side of the compressor 144. The optional heater 166 is a conventional electric in-line heater such as made by the Omega Company.

A solenoid valve 170, whose outlet is connected to the suction line 164, serves as a fill port for charging the secondary refrigeration loop 112. An inlet of the solenoid valve 170 is connected to a gas source (not shown). An inlet of a solenoid valve 172, which is an optional element, is connected to the flow line between the outlet of the heat exchanger 156 and the inlet 140 of the refrigeration process 122. The optional solenoid valve 172 serves as a venting port for the secondary refrigeration loop 112. The solenoid valve 170 and the optional solenoid valve 172 are conventional solenoid on/off valves, such as Sporlan valves.

A conventional pressure switch (PS) 174 is disposed at the supply outlet of the recuperative heat exchanger 152, a conventional PS 178 is disposed at the inlet of the compressor 144, an optional conventional temperature switch (TS) 180 is disposed downstream of the heater 154, and an optional conventional TS 182 is disposed downstream of the heater 166.

Except for the temperature switches, all elements of the secondary refrigeration loop 112 are mechanically and/or hydraulically connected.

Those skilled in the art will appreciate that a control/safety circuit (not shown) provides control to, and receives feedback from, a plurality of control devices disposed within the refrigeration system 100, such as pressure and temperature switches. The PS 174, the PS 178, the TS 180, and the TS 182 are examples of such devices. However, there are many other sensing devices disposed within the refrigeration system 100, which are for simplicity not shown in FIG. 1. Pressure switches, including the PS 174, and the PS 178, are typically pneumatically connected, whereas temperature switches, including the TS 180 and the TS 182, are typically thermally coupled to the flow lines within the refrigeration system 100. The controls from the control/safety circuit are electrical in nature. Likewise, the feedback from the various sensing devices to the control/safety circuit is electrical in nature.

Having described the refrigeration system components and their relationship to one another, we now describe the operation of the system. The refrigeration system 100 is characterized by three modes of operation:

(1) Normal cooling mode—in which the customer-installed external heat load heat exchanger 158 is cooled continuously to a temperature of between −80 and −150° C.;

(2) Bakeout mode—in which the customer-installed external heat load heat exchanger 158 is heated via a heater (not shown) to a temperature of between +200 and +350° C.; and (3) Post-bake cooling mode—in which the customer-installed external heat load heat exchanger 158 is gradually cooled from the bakeout temperature to the normal cooling mode temperature of between −80 and −150° C.

Normal Cooling Mode: With reference to FIG. 1, the secondary refrigeration loop 112 is initially charged via a gas source (not shown) feeding the solenoid valve 170, whose outlet feeds the suction side of the compressor 144 after passing through the pressure regulator 168. The PS 178 senses the gas pressure upstream of the pressure regulator 168 and controls the solenoid valve 170. When the pressure reaches the set value of the PS 178 the solenoid valve 170 closes. The pressure regulator 168 ensures that a certain desired pressure at the suction side of the compressor 144 is maintained.

The gas is compressed via the compressor 144 to a discharge pressure that is typically in the range of 100 to 400 psi, where the pressure limit is determined by the connecting lines of the customer-installed external heat load heat exchanger 158. A main design consideration is that the compression ratio for the compressor 144 is properly matched for the gas being pumped so that excessive discharge temperatures in the compressor 144 are avoided.

The high-pressure gas stream flows from the compressor 144 to the after-cooler 146, which subsequently removes the heat of compression from the compressed gas that is exiting the compressor 144, thereby cooling the gas stream to a temperature typically between 25 and 40° C. In addition, the heat of compression may also be removed by an oil flow circulating through the after-cooler 146.

The gas stream then flows through the oil separator 148 and the adsorber 150, which remove any remaining traces of oil in the gas stream, such that the gas steam exiting the adsorber 150 is very clean. The gas stream then enters the recuperative heat exchanger 152 that provides further cooling to the gas stream via the cold gas returning from the customer-installed external heat load heat exchanger 158. As a result, the gas stream exiting the supply outlet of the recuperative heat exchanger 152 is typically between −30 and +30° C. The optional heater 154 installed downstream of the recuperative heat exchanger 152 ensures the temperature of the gas entering the optional heat exchanger 156 is warm enough not to freeze the water circulating on the other side of the heat exchanger 156.

The gas stream then flows into the refrigeration process 122 of the primary refrigeration system 110 where it is progressively cooled to ultra-low temperatures via the secondary flow path of first the heat exchanger 130, then the heat exchanger 134, and finally the heat exchanger 136, thereby exiting the refrigeration process 122 via the evaporator feed line 142 having been cooled to a temperature of between −80 to −150° C.

This cold gas then enters the customer-installed external heat load heat exchanger 158 and proceeds to flow within the customer-installed external heat load heat exchanger 158 via a predetermined flow pattern such that a uniform surface temperature is achieved. Due to the flowing action within the customer-installed external heat load heat exchanger 158, heat is transferred to the cold gas as it passes through the customer-installed external heat load heat exchanger 158 and subsequently exits the customer-installed external heat load heat exchanger 158 at a temperature of between −30 and −140° C.

The gas stream then enters the return side of the recuperative heat exchanger 152, thereby providing cooling to the supply side, as mentioned above. By contrast, this gas flowing in the return side of the recuperative heat exchanger 152 is warmed by picking up the heat rejected by the high-pressure gas flowing in the supply side of the recuperative heat exchanger 152. As a result, the gas leaving the recuperative heat exchanger 152 and subsequently feeding the suction side of the compressor 144 via the suction accumulator tank 162 and the suction line 164 is at a temperature of between −40 and +50° C.

The gas flowing in the suction line 164 is further warmed by the heater 166 under the control of TS 182 to a temperature that satisfies the input requirements of the compressor 144. The pressure at the suction side of the compressor 144 is typically between 2 and 100 psi, it is important that this pressure not drop below zero psi. The secondary refrigeration loop 112 is thus operating in a closed-loop fashion, thereby recirculating the full volume of refrigerant gas.

Bakeout Mode: The primary refrigeration system 110 and the secondary refrigeration loop 112 are turned off by deactivating the compressor 114 and the compressor 144, respectively. As a result, there is no gas flow during the bakeout mode. During bakeout mode the customer-installed external heat load heat exchanger 158 is heated via a heater (not shown) to a temperature between +50 and +350° C.

Post-bake Cooling Mode: Upon completion of the bakeout process, the customer-installed external heat load heat exchanger 158 must be restored from a high temperature of up to +350° C. to its normal cold temperature of between −80 to −150° C. as rapidly as possible without experiencing thermal shock. To optimize this cool-down period, refrigerant gas is pumped through the customer-installed external heat load heat exchanger 158 by activating the compressor 144 of the secondary refrigeration loop 112. Initially, the compressor 114 of the primary refrigeration system 110 remains off so that the customer-installed external heat load heat exchanger 158 will not experience thermal shock due to sudden exposure to the ultra-low temperatures produced by the primary refrigeration system 110. The gas now supplied to the customer-installed external heat load heat exchanger 158 by the secondary refrigeration loop 112 only is at a temperature of between +30 and +300° C. Initially, the temperature of the gas leaving the customer-installed external heat load heat exchanger 158 is as high as +350° C. but over time this temperature is gradually reduced due to the cooling action of the gas flowing in the secondary refrigeration loop 112.

More specifically, the hot gas returning from the customer-installed external heat load heat exchanger 158 is cooled in the recuperative heat exchanger 152, as the heat rejected by the hot gas is picked up by the counter flow gas entering heat exchanger 152 at ambient temperature. As a result, the temperature of high-pressure gas leaving the recuperative heat exchanger 152 could rise above 100° C.; thus it is necessary to further cool this gas steam. Consequently, the optional heater 154 is deactivated during the post-baked cooling mode and the optional heat exchanger 156 is activated.

Once the customer-installed external heat load heat exchanger 158 is cooled to between ambient and +50° C. the primary refrigeration system 110 is turned on by activating the compressor 114, thereby further cooling the gas entering the customer-installed external heat load heat exchanger 158 to the normal operating temperature of between −80 to −150° C.

During the post-bake cooling mode it may be necessary to control the temperature differences of the two gas streams of the recuperative heat exchanger 152. Since the gas flow rate in each of the streams affects the temperature difference between each stream, the temperature difference can be controlled by having differing gas flow rates in each of the two streams within the recuperative heat exchanger 152. However, in a closed-loop system these two flow rates are inherently equal. Therefore, to achieve a means to control the temperature differences of the two gas streams of the recuperative heat exchanger 152, a way to create an imbalanced flow rate between the two streams has been provided in accordance with the invention. The flow rates in each stream of the recuperative heat exchanger 152 can be varied by venting part of the high-pressure flow stream after it leaves the heat exchanger 156 via the solenoid valve 172. In this way the gas is exhausted from the high-pressure flow stream and consequently not returned to the secondary refrigeration loop 112, thereby creating a flow imbalance between the supply and return side of the loop. Typically, this process takes place once a week and lasts for a few minutes. A loss of gas due to venting is insignificantly compared to an open-loop system.

In order to keep the total volumetric flow constant at the suction inlet of the compressor 144 the amount of gas vented must be made up. This is accomplished by the PS 178 sensing that the gas pressure upstream of the pressure regulator 168 has fallen below its set value and subsequently opening the solenoid valve 170 and letting fresh gas enter the secondary refrigeration loop 112. The flexibility of venting part of the flow during the post-bake cooling mode allows the maximum temperature of the gas entering the suction inlet of the compressor 114 to be limited.

In any of the throe operating modes, the gas pressure of the suction line 164 in the secondary refrigeration loop 112 is continuously monitored and in the event of a gas leak the secondary refrigeration loop 112 is automatically replenished with gas. Upon sensing a pressure deficiency in the secondary refrigeration loop via the PS 178, the solenoid valve 170 is automatically opened and the gas is replenished. When the pressure reaches the set value of the PS 178, the solenoid valve 170 is automatically closed.

In general, the PS 174, the PS 178, the TS 180, and the TS 182 are controls necessary to operate the refrigeration system 100 during the three different modes. The PS 178 senses the gas pressure upstream of the suction port of the compressor 144. The PS 174 senses the high-pressure stream downstream of the compressor 144 after the adsorber 150. When the pressure goes below the value set at the PS 178 for the low-pressure side upstream of the suction port of the compressor 144, the solenoid valve 170 opens and gas from the source is introduced into the suction side of the compressor 144 so that the compressor does not shut off. This ensures that the pressure in the recirculating gas loop never goes below the set value or into vacuum. The PS 174 on the discharge side of the gas loop ensures that the compressor 144 is deactivated when the pressure exceeds the value set on the PS 174. The PS 174 also insures that the limits of the connecting lines of the customer-installed external heat load heat exchanger 158 are not exceeded. Similarly, the TS 180 and the TS 182 accurately control the temperature of the two gas streams of the recuperative heat exchanger 152, as described earlier.

In a first embodiment in accordance with the invention, the optional heat exchangers and heaters 154, 156, and 166 are not used. In this embodiment the recuperative heat exchanger 152 provides the means of protecting the gas compressor 144 from receiving gas that is beyond its design limits.

In the cool mode, the heat exchanger 152 warms the returning cold gas to a temperature that is typically between −40 C and +20° C. The warm end of this range is dictated mainly by the sizing of heat exchanger 152, the heat load on the heat exchanger 152, and the temperature of the gas exiting the after-cooler 146, which is in turn determined by the temperature of the media receiving heat rejected by the after-cooler 146. The high-pressure gas exiting the adsorber 150 is cooled in the heat exchanger 152 by the cold low pressure gas returning from the customer-installed heat load heat exchanger 158. The cooling of the high-pressure gas exiting heat exchanger 152 reduces the thermal load on the refrigeration process 122.

In the post bakeout mode, the heat exchanger 152 cools the hot gas returning from customer-installed beat load heat exchanger 158 to a temperature that is typically between +50 C and +25° C. The cold end of this range is dictated mainly by the sizing of heat exchanger 152, the heat load on the heat exchanger 152, and the temperature of the gas exiting the after-cooler 146, which is in turn determined by the temperature of the media receiving heat rejected by the after-cooler 146.

The preferred sizing of the heat exchanger 152 is such that the heat exchanger 152 is not fully effective. That is, the heat exchanger 152 is somewhat undersized such that the hot gas entering the heat exchanger 152 is only partially cooled down by the high-pressure gas stream and does not fully reach the temperature of the high-pressure gas entering the heat exchanger 152. Typically, the low-pressure stream of hot gas exits between 5 and 30 degrees warmer than the inlet temperature of the high-pressure gas stream. In this manner some of the heat returning from the customer-installed external heat load heat exchanger 158 is passed to the gas compressor 144 and ultimately to the after-cooler 146, from which it can be rejected to the environment and removed from the system. In addition, the flow of the high-pressure gas stream that has absorbed the heat from the low-pressure gas returning from the customer-installed heat load heat exchanger 158 flows through the refrigeration process 122, which provides a means to remove some of the heat from the high-pressure gas stream.

In this embodiment the primary refrigeration process 110 is turned off during the post bakeout process and serves as a mass that absorbs heat from the gas stream. The net removal of heat from the customer-installed external heat load heat exchanger 158 reduces its temperature, which in turn reduces the temperature of the low-pressure gas entering the heat exchanger 152, and consequently lowers the temperature of the high-pressure gas exiting the heat exchanger 152. Once the temperature of the high-pressure gas exiting the heat exchanger 152 reaches an acceptable level, typically around room temperature, the refrigeration process 122 can be activated. Depending on the specifics of the system, this threshold temperature may be higher depending on the refrigeration capacity of the refrigeration process 122.

In a second embodiment in accordance with the invention, a three-way valve, or two one-way valves (not shown), is added at the high-pressure outlet of the heat exchanger 152. This valve controls the flow of high-pressure gas and acts to select whether the high-pressure gas feeds directly into the refrigeration process 122 or whether the high-pressure gas bypasses around the refrigeration process 122. If the high-pressure gas is selected to bypass the refrigeration process, the high-pressure gas may connect to the gas supply line 142 between the refrigeration process 122 and the customer-installed external heat load heat exchanger 158. In this embodiment, the high-pressure gas exiting the heat exchanger 152 bypasses the refrigeration process 122 whenever the high-pressure gas exits heat exchanger 152 above a predetermined temperature, for example, above ambient temperature.

In a third embodiment in accordance with the invention, the heat exchangers 154, 156 and 164 are used to assure that the gas entering the gas compressor 144 and the refrigeration process 122 are within design limits.

In the cool mode, the heat exchanger 152 warms the cold gas returning from the customer-installed heat load heat exchanger 158 by cooling the high-pressure gas stream that enters the heat exchanger 152 from the adsorber 150. The low-pressure gas exiting the heat exchanger 152 is heated as needed by an electric heater 166 to achieve the required inlet temperature to the gas compressor 144. The high-pressure gas cooled by the heat exchanger 152 is heated by the electric heater 154 and is further regulated by the heat exchanger 156. However, under normal operation, no significant heat transfer occurs. The heat exchanger 156 exchanges heat with a media such as water, a water/glycol mixture, or similar heat transfer media.

In the post bakeout mode, hot gas returning from the customer-installed external heat load heat exchanger 158 is cooled by the heat exchanger 152. The heater 166 is not activated since it is not necessary to heat the gas exiting the heat exchanger 152. The high-pressure gas is heated by the heat exchanger 152. The electric heater 154 is not activated since heating the high-pressure gas is not required. Heat is removed from the high-pressure gas by the heat exchanger 156.

A portion of the high-pressure gas exiting the heat exchanger 156 is vented to atmosphere by the valve 172. This has the effect of reducing the flow of gas to the customer-installed external heat load heat exchanger 158 and subsequently improving the ability of the heat exchanger 152 to cool the low-pressure gas returning from the customer-installed heat load heat exchanger 158 since there is a greater flow of room-temperature high-pressure gas than low-pressure returning hot gas. This has the effect of improving the effectiveness of heat exchanger 152. In this embodiment, a high effectiveness of the heat exchanger 152 is preferred, in contrast to the first embodiment. The reduced flow rate of returning gas is made up by new gas entering from the solenoid valve 170. The mixing of this room temperature gas further cools the gas returning from heat exchanger 152.

In a fourth embodiment in accordance with the invention, the heater 154 and the heat exchangers 152 and 156 are not used, and the heater 166 is replaced with a heat exchanger 166. The heat exchanger 166 exchanges heat with water, a water/glycol mixture, or similar heat transfer medium that is near room temperature. The heat exchanger 166 regulates the temperature of low-pressure gas returning from the customer-installed heat load heat exchanger 158.

The temperature of the low-pressure gas leaving the heat exchanger 166 is around room temperature. Since the temperature of the low-pressure gas can be either below freezing or above the normal boiling point of various cooling fluids before entering this heat exchanger 166, the heat exchanger 166 is designed to operate with a minimum flow to assure that the cooling fluid will not freeze or boil. Preferably, a flow switch is used to sense the fluid flow.

If the flow of the cooling fluid falls below an acceptable limit the flow switch turns off the gas compressor 144 to present a freeze-out or boiling condition. Alternately, a temperature sensor may be used instead of a flow sensor.

In a fifth embodiment in accordance with the invention, any significant loss of gas from the refrigeration system 100 is sensed and is replenished with new gas. A change in the switch position of the pressure switch 178 occurs if the suction pressure of gas compressor 144 drops below a predetermined level. The pressure switch 178 may be used to activate the valve 170, which opens to allow new gas into the refrigeration system 100 until the suction pressure sensed by pressure switch 178 reaches a predetermined level, causing the switch position of the pressure switch 178 to change and the valve 170 to close.

In an alternative arrangement, the pressure switch 178 is replaced by a pressure sensor such as a pressure transducer that produces a signal sensed by a controller and used to activate a relay that in turn controls the valve 170. Alternately, the valve 170 may be installed in the field by the customer. In this case, the manufactured unit merely has a connection point at which new gas can be added during operation. Similarly, the pressure switch 178 is added in the field as well.

An additional feature of this embodiment is a provision to allow additional gas to be added to the secondary refrigeration loop 112 to assure that an appropriate gas charge is installed in the secondary refrigeration loop 112. Typical supply pressure of gasses such as nitrogen is typically no greater than 80 psi. The gas is charged into the secondary refrigeration loop 112 with the secondary gas compressor 144 switched off. The maximum pressure the secondary refrigeration loop 112 can be charged to is the typical facility supply pressure of 80 psi.

When the gas compressor 144 is switched on, the suction pressure drops below the value set on the pressure switch 178, which in turn activates the solenoid valve 170 and enables gas to be drawn into the suction side of the gas compressor 144. When the correct amount of gas is drawn into the secondary refrigeration loop, the pressure switch 178 deactivates the solenoid valve 170 and the gas supply into the secondary refrigeration loop is cut off. Thus, the auto make-up capability facilitates drawing additional gas into the secondary refrigeration loop 112 and enables an optimum amount of gas to be introduced into the secondary refrigeration loop 112.

When the gas compressor 144 is switched off the static balance pressure may be cater than the supply pressure of 80 psi typically available in the facilities. Without auto make-up ability it would be necessary to have high-pressure gas bottles to charge the secondary refrigeration loop 112 to an appropriate pressure level and thus, the inconvenience of carrying high-pressure gas bottles in the facility is avoided.

In a sixth embodiment in accordance with the invention, the secondary refrigeration loop 112 may include alternative compressor types in place of the gas compressor 144. More specifically, the secondary refrigeration loop 112 may include a refrigeration compressor, such as the compressor 114 of the primary refrigeration system 110, in place of the gas compressor 144. The secondary refrigeration loop 112 may include an oil-less compressor instead of the gas compressor 144.

In a seventh embodiment in accordance with the invention, the recuperative heat exchanger 152 of the secondary refrigeration loop 112 may be replace by two water-cooled heat exchangers identical to heat exchanger 156. In this case, a first water-cooled heat exchanger is inserted into the high-pressure gas supply line downstream of the adsorber 150 in place of the recuperative heat exchanger 152. Similarly, a second water-cooled heat exchanger is inserted into the return line 160 upstream of the suction accumulator tank 162 in place of the recuperative heat exchanger 152. In this case, the water temperature of the two water-cooled heat exchangers is such that freezing or boiling is prevented depending on the operating mode. Furthermore, the gas temperature achieved will be maintained close to the water temperature.

What is claimed is:

1. A process of using an ultra-low temperature closed-loop recirculating gas chilling system for reducing the temperature of an object or fluid from a temperature in the range of from about +50° C. to about +350° C. to a temperature in the range of from about −30° C. to about −150° C., the process comprising:

providing an object or fluid at a temperature in the range of from about +50° C. to about +350° C. in a sealed external heat exchanger in fluid connection with a closed loop chilling system itself comprising a primary refrigeration system and a secondary gas coolant system;

a. wherein the primary refrigeration system comprises, in series fluid connection, a compressor, a condenser, at least one heat exchanger, and at least one flow metering device;

b. wherein the secondary gas coolant system comprises, in fluid connection, a compressor, an aftercooler, and a means to protect the compressor from excessively low or high temperatures;

c. wherein the primary refrigeration system and secondary gas coolant system are indirectly connected by an outlet line from the secondary gas coolant system to a secondary inlet of the at least one heat exchanger of the primary refrigeration system;

d. wherein the secondary outlet line from the at least one heat exchanger of the primary refrigeration system is in fluid connection with the sealed external heat exchanger containing the object or fluid to be chilled; and e. wherein the sealed external heat exchanger is in fluid connection with the means to protect the compressor from excessively low or high temperatures in the secondary gas coolant system;

and actuating at least one of the primary refrigeration system and the secondary refrigeration system to reduce the temperature of the object or fluid being cooled to a temperature in the range of from about −30° C. to about −150° C.

2. An ultra-low temperature closed-loop recirculating gas chilling system capable of reducing the temperature of an object or fluid from a temperature in the range of from about +50° C. to about +350° C. to a temperature in the range of from about −30° C. to about −150° C., the system comprising:

a primary refrigeration system comprising, in series fluid connection, a compressor, a condenser, at least one heat exchanger, and at least one flow metering device;

a secondary gas coolant system comprising, in fluid connection, a compressor, an aftercooler, and a means to protect the compressor from excessively low or high temperatures;

the primary refrigeration system and secondary gas coolant system being indirectly connected by an outlet line from the secondary gas coolant system to a secondary inlet of the at least one heat exchanger of the primary refrigeration system;

the secondary outlet line from the at least one heat exchanger of the primary refrigeration system being in fluid connection with a sealed external heat exchanger containing the object or fluid to be chilled; and the sealed external heat exchanger being in fluid connection with the means to protect the compressor from excessively low or high temperatures in the secondary gas coolant system.

3. The process of claim 1 wherein the object or fluid being cooled is a semiconductor chuck or a fluid for flowing through a semiconductor chuck.

4. The process of claim 1 wherein the means to protect the compressor of the secondary gas coolant system from excessively low or high temperatures is selected from the group consisting of at least one of:

a) a gas-to-gas recuperative heat exchanger in which high pressure gas downstream of the aftercooler exchanges heat with low pressure gas prior to its entry to the compressor;

b) a gas-to-liquid cooled heat exchanger in which an external liquid exchanges heat with low pressure gas prior to its entry to the compressor; and c) a heat exchanger that adds heat to low pressure gas prior to entry to the compressor.

5. The process of claim 1 further comprising:

using a gas-to-gas heat exchanger, exchanging heat between the gas stream exiting the aftercooler and gas returning from the external heat exchanger.

6. The process of claim 1 wherein the closed loop chilling system further comprises a liquid-cooled heat exchanger placed between the external heat exchanger and the inlet of the compressor of the secondary gas coolant system.

7. The process of claim 6 wherein the liquid-cooled heat exchanger is a water-cooled heat exchanger.

8. The process of claim 1 wherein the closed loop chilling system further comprises a heater placed on a return line for returning cold gas.

9. The process of claim 1 wherein each compressor is selected from the group consisting of a reciprocating compressor, a rotary compressor, a screw compressor or a scroll compressor.

10. The process of claim 9 wherein at least one compressor is a scroll compressor.

11. The process of claim 1 wherein the closed loop chilling system further comprises a solenoid valve for replenishing lost coolant gas when a pressure deficiency exists in a secondary refrigeration loop.

12. The process of claim 1 wherein the closed loop chilling system further comprises a control system for replenishing lost coolant gas when a pressure deficiency exists in a secondary refrigeration loop.

13. The process of claim 1 wherein the closed loop chilling system further comprises a valve at the high pressure outlet of at least one heat exchanger to select whether gas feeds directly into a refrigeration process or bypasses the refrigeration process.

14. The process of claim 1 wherein the refrigerant comprises a nonflammable, chlorine-free, nontoxic mixed refrigerant blend.

15. The process of claim 1, further comprising:

actuating the secondary refrigeration system to reduce the temperature of the object or fluid being cooled to a temperature in the range of ambient to +50° C.; and when the temperature of the object or fluid being cooled reaches a temperature below +50° C., actuating the primary refrigeration system to reduce the temperature of the objector fluid being cooled to a temperature in the range of from about −30° C. to about −150° C.

16. The system of claim 2 wherein the object or fluid being cooled is a semiconductor chuck or fluid for flowing through a semiconductor chuck.

17. The system of claim 2, wherein the means to protect the compressor of the secondary gas coolant system from excessively low or high temperatures is selected from the group consisting of at least one of:

a) a gas-to-gas recuperative heat exchanger in which high pressure gas downstream of the aftercooler exchanges heat with low pressure gas prior to its entry to the compressor;

b) a gas-to-liquid cooled heat exchanger in which an external liquid exchanges heat with low pressure gas prior to its entry to the compressor; and c) a heat exchanger that adds heat to low pressure gas prior to entry to the compressor.

18. The system of claim 2, further comprising a gas-to-gas heat exchanger, that exchanges heat between the gas stream exiting the aftercooler and gas returning from the external heat exchanger.

19. The system of claim 2, further comprising a liquid-cooled heat exchanger placed between the external heat exchanger and the inlet of the compressor of the secondary gas coolant system.

20. The system of claim 19 wherein the liquid-cooled heat exchanger is a water- cooled heat exchanger.

21. The system of claim 2, further comprising a heater placed on a return line for returning cold gas.

22. The system of claim 2, wherein each compressor is selected from the group consisting of a reciprocating compressor, a rotary compressor, a screw compressor or a scroll compressor.

23. The system of claim 22, wherein at least one compressor is a scroll compressor.

24. The system of claim 2, further comprising a solenoid valve for replenishing lost coolant gas when a pressure deficiency exists in a secondary refrigeration loop.

25. The system of claim 2, further comprising a control system for replenishing lost coolant gas when a pressure deficiency exists in a secondary refrigeration loop.

26. The system of claim 2, further comprising a valve at the high pressure outlet of at least one heat exchanger to select whether gas feeds directly into a refrigeration process or bypasses the refrigeration process.

27. The system of claim 2, wherein the refrigerant comprises a nonflammable, chlorine-free, nontoxic mixed refrigerant blend.

* * * * *